United States Patent [19]

Zaloga

[11] 4,007,673

[45] Feb. 15, 1977

[54] REGISTER WITH AIR-DRIVEN OSCILLATING LOUVERS

[76] Inventor: Peter P. Zaloga, 5818 W. Newport, Chicago, Ill. 60634

[22] Filed: Nov. 10, 1975

[21] Appl. No.: 630,143

[52] U.S. Cl. ..... 98/40 V; 98/110; 98/116; 98/94 R; 98/107; 415/125

[51] Int. Cl.[2] ..... E06B 7/02; F24F 13/06; F24F 13/08

[58] Field of Search ..... 98/40 V, 107, 94 AC, 98/121 A, 116, 117, 99.8, 108; 415/125

[56] References Cited

UNITED STATES PATENTS

| | | | |
|---|---|---|---|
| 2,196,308 | 4/1940 | Johnston | 98/40 V |
| 2,800,851 | 7/1957 | Kronrad et al. | 98/40 V |
| 2,824,429 | 2/1958 | Zucker | 98/40 V |
| 3,242,846 | 3/1966 | Bunn | 98/40 V |
| 3,380,372 | 4/1968 | Perry | 98/121 A |
| 3,601,034 | 8/1971 | Thorne | 98/110 |
| 3,677,166 | 7/1972 | Sisk, Jr. et al. | 415/125 |
| 3,699,873 | 10/1972 | Irvin | 98/116 |
| 3,777,650 | 12/1973 | Wenig | 98/40 V |
| R28,650 | 12/1975 | Sisk, Jr. et al. | 415/125 |

*Primary Examiner*—William F. O'Dea
*Assistant Examiner*—Henry C. Yuen
*Attorney, Agent, or Firm*—Prangley, Dithmar, Vogel, Sandler & Stotland

[57] ABSTRACT

An air register for mounting in a duct outlet of a forced air heating or ventilation system includes a frame carrying a plurality of pivotally movable horizontal and vertical louvers disposed in the stream of air from the duct. A generally cylindrical reel-type windmill is mounted on the frame for rotation by the stream of air about an axis disposed substantially perpendicular to the direction of the stream of air, and is coupled by a speed reducing gear train and a crank mechanism to a connecting rod interconnecting the vertical louvers for effecting continuous oscillatory movement thereof in response to rotation of the windmill by the stream of air for continuously varying the direction of the stream of air from the register. The entire apparatus is dimensioned and arranged to fit within the 2¾-inch depth of a standard room wall air duct outlet.

10 Claims, 5 Drawing Figures

10
11
12
12"
13
14
15
16
17
20
21
22
23
24
25
26
27
30
35
38
40
41
42
44
45
46
47
48
49
50
51
52
53
55
56
60
70
71
72
75
2¼"
2¾"

70
71
72
73
75
76
5
5

70
71
72
74
75
76
77
1½"

REGISTER WITH AIR-DRIVEN OSCILLATING LOUVERS

BACKGROUND OF THE INVENTION

The present invention relates generally to air-driven means for continuously varying the direction of the stream of air from a duct outlet of a forced air heating or ventilation system. Air registers with air-driven oscillating louvers or other air stream deflecting means are known in the art, representative prior art devices being disclosed, for example, in U.S. Pat. No. 2,196,308 issued to F. Johnston on Apr. 9, 1940, U.S. Pat. No. 2,800,851, issued to J. Kronrad et al. on July 30, 1957, U.S. Pat. No. 3,242,846 issued to C. E. Bunn on Mar. 29, 1966, and U.S. Pat. No. 3,699,873 issued to A. H. Irvin on Oct. 24, 1972. However, each of these prior art devices utilizes a standard fan wheel with angled radial blades adapted to be operative in response to an air stream moving in a direction generally parallel to the axis of rotation of the fan wheel.

The maximum dimensions of such fan wheels are in a plane perpendicular to the direction of the air stream and, therefore, such fan wheels are not suitable for use in flat, narrow ducts. More particularly, such fan wheels could not be mounted in the standard home wall duct which has transverse dimensions of approximately 2¼ inches by 12 inches, with a maximum depth at the register outlet of 2¾ inches. In use, such ductwork is arranged with the 12-inch dimension parallel to the room wall, with the register opening being in the wall a slight distance above the floor, the shallow 2¼-inch depth being necessary in order to permit the duct to be accommodated between the interior and exterior walls of the building. A standard fan blade of the type disclosed in the prior art, in order to be utilized in such a duct, would have to have a diameter of considerably less than 2¾ inches, since the louvers must also be accommodated in this 2¾-inch space. With the 100 cubic feet per minute airflow in the standard home heating system, a fan blade of such a small diameter would be insufficient to generate the power needed to drive the louvers.

SUMMARY OF THE INVENTION

The present invention provides a novel air-driven oscillatable air deflecting means for controlling the direction of air emanating from the registers of a heating or ventilating system without the use of an external power source. More particularly, the present invention provides an improved air regulating mechanism, which includes air-driven oscillatable louvers, the entire mechanism being capable of being mounted in the 2¾-inch maximum depth at the outlet of a room wall duct in a home forced-air system.

It is another general object of this invention to provide an air register of the type set forth, wherein the windmill mechanism is lightweight and has very low drag and inertia so as to minimize the airflow necessary to effect rotation thereof.

It is a particular object of this invention to provide an air register of the type set forth, wherein the windmill means includes a generally cylindrical reel-type windmill having a longitudinal axis of rotation disposed substantially horizontally in use, the maximum outer diameter of the windmill being no greater than about 1½ inches, but having a length sufficient to generate more than adequate power to drive the air deflecting means.

It is an important object of this invention to provide an air register for directing a stream of air from a duct of a forced air heating or ventilation system, the register comprising a frame defining an air outlet port through which the associated stream of air may flow, air deflecting means carried by the frame in the outlet port for movement in the associated stream of air, air-driven windmill means mounted on the frame for rotation by the associated stream of air about an axis disposed substantially perpendicular to the direction of the stream of air, and linkage means operably coupling the windmill means and the air deflecting means to effect movement of the air deflecting means upon rotation of the windmill means by the associated stream of air thereby to vary the direction of the stream of air as it passes through the outlet port.

In connection with the foregoing object, it is another object of this invention to provide an air register of the type set forth, wherein the windmill means includes a pair of spaced-apart circular end members rotatably carried by the frame coaxial with the axis and a plurality of elongated vanes extending between the end members and supported thereby substantially parallel to the axis and equiangularly spaced therearound.

In connection with the foregoing object, still another object of this invention is to provide an air register of the type set forth, wherein the air deflecting means are mounted for oscillatory movement, the windmill means being coupled to the air deflecting means by a speed reduction means and a crank mechanism.

Further features of the invention pertain to the particular arrangement of the parts of the air register whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
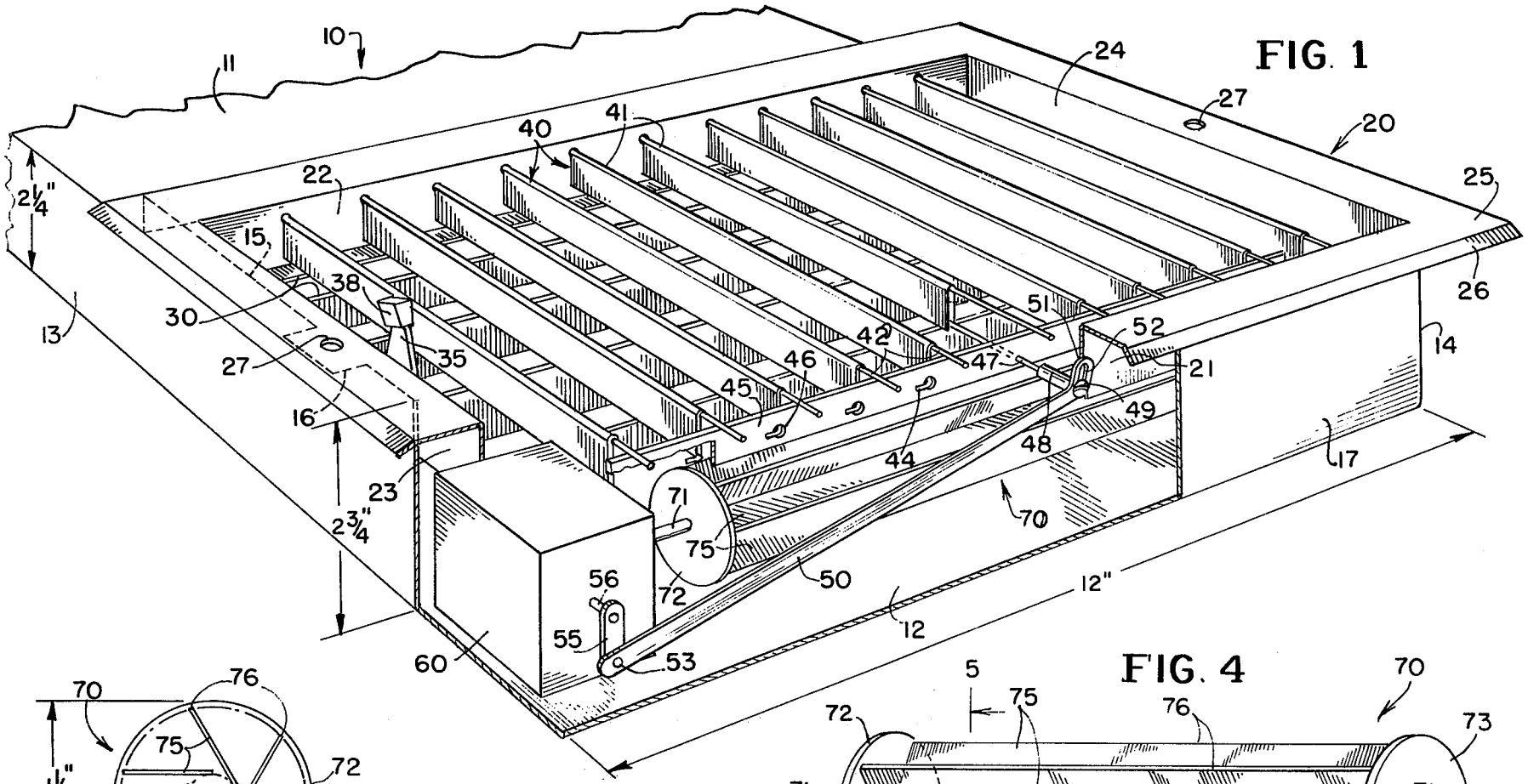
FIG. 1 is a fragmentary inverted front perspective view in partial section of an air register constructed in accordance with and embodying the features of the present invention, as viewed from the top thereof, with portions of the mechanism broken away more clearly to show the structure thereof.

Referring now to FIG. 1 of the drawings, there is illustrated the wall outlet portion of a wall duct, generally designated by the numeral 10, having mounted therein a register, generally designated by the numeral 20, constructed in accordance with and embodying the features of the present invention. The air duct 10 is preferably of standard sheet metal construction, the duct 10 being rectangular in transverse cross section and including a front wall 11, a rear wall 12 and a pair of opposed side walls 13 and 14, the distance between the front and rear walls 11 and 12 along the side walls 13 and 14 being 2¼ inches, and the distance between the side walls 13 and 14 along the front and rear walls 11 and 12 being 12 inches. In use, the duct 10 extends upwardly behind an interior room wall (not shown) of a home or other building, and terminates adjacent to an air outlet opening in the wall. More particularly, the front wall 11 terminates at the bottom of the wall opening, while the rear wall 12 and side walls 13 and 14 continue to the top of the interior wall opening, terminating at an end wall 17.

The side walls 13 and 14 extend along the inside edge of the rectangular opening in the interior room wall, and are provided with extensions as at 15 extending from the top to the bottom of the interior room wall opening having a length of approximately ½ inch, this being the standard thickness of interior dry wall panels. Thus, adjacent to the interior room wall opening, the duct side walls 13 and 14 have a depth of approximately 2¾ inches, the inner edges of the side walls being substantially flush with the inner surface of the interior room wall. Each of the duct side wall extensions 15 is provided intermediate the ends thereof with an outturned attachment flange 16 having an opening therethrough for receiving a suitable fastener such as a sheet metal screw 18 or the like (see FIG. 3) for attachment of the register 20, as will be described below.

Referring now also to FIGS. 2 through 5 of the drawings, the register 20 is generally rectangular in shape and includes a rectangular top wall 21 and a rectangular bottom wall 22 and two opposed rectangular side walls 23 and 24. In use, the top and bottom walls 21 and 22 are respectively disposed substantially parallel to the duct end wall 17, with the register top wall 21 being fitted just inside the duct end wall 17 in overlapping relationship therewith, while the register bottom wall 22 overlies the upper edge of the duct front wall 11. The register side walls 23 and 24 are respectively received along the inside surfaces of the duct side walls 13 and 14 in parallel relationship thereto. The register walls 21 through 24 cooperate to define an air outlet port for the duct 10 and the register 20. The register 20 is provided with an attachment flange 25 extending about the entire periphery thereof and disposed substantially perpendicular to the walls 21 through 24 integral therewith, the flange 25 having an inturned lip 26 disposed in use flush against the interior room wall. The peripheral attachment flange 25 is provided along the opposite side edges thereof with mounting holes 27 disposed in use congruent with the mounting holes through the duct attachment flanges 16 and receiving therethrough the attachment screws 18 for securing the register 20 to the duct 10.

The register 20 is provided with a plurality of horizontally extending louvers 30, each constituting a generally flat rectangular member provided at the opposite ends thereof with integral attachment flanges 31 (only one end shown) for receiving therethrough associated pivot pins 32 for pivotally mounting the louvers 30 on the register side walls 23 and 24. Each of the louvers 30 is also provided at the right-hand end thereof, as viewed in FIG. 3, with another attachment flange 33 disposed adjacent to the bottom or inner edge of the louver 30 and adapted for pivotal connection to a connecting rod 34 which extends vertically along the duct side wall 13 and commonly connects the louvers 30. The connecting rod 34 is in turn pivotally coupled to an adjustment lever 35 which is pivotally mounted to an attachment flange 37 on the register side wall 23 by means of a pivot pin 36, the adjustment lever 35 being provided with a handle member 38 to facilitate manual actuation thereof.

Figure 4:
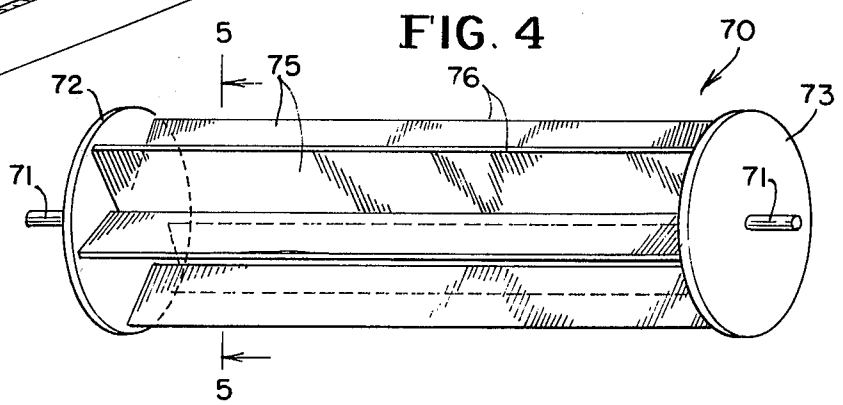
FIG. 4 is a front perspective view of the windmill structure of the present invention.
Figure 5:
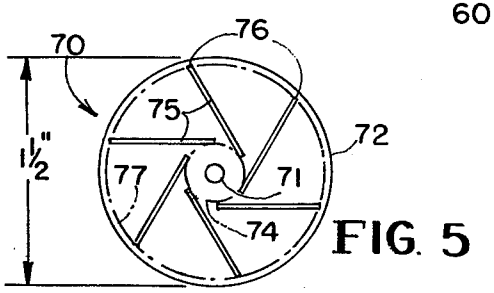
FIG. 5 is a view in vertical section taken along the line 5—5 in FIG. 4.
Figure 3:
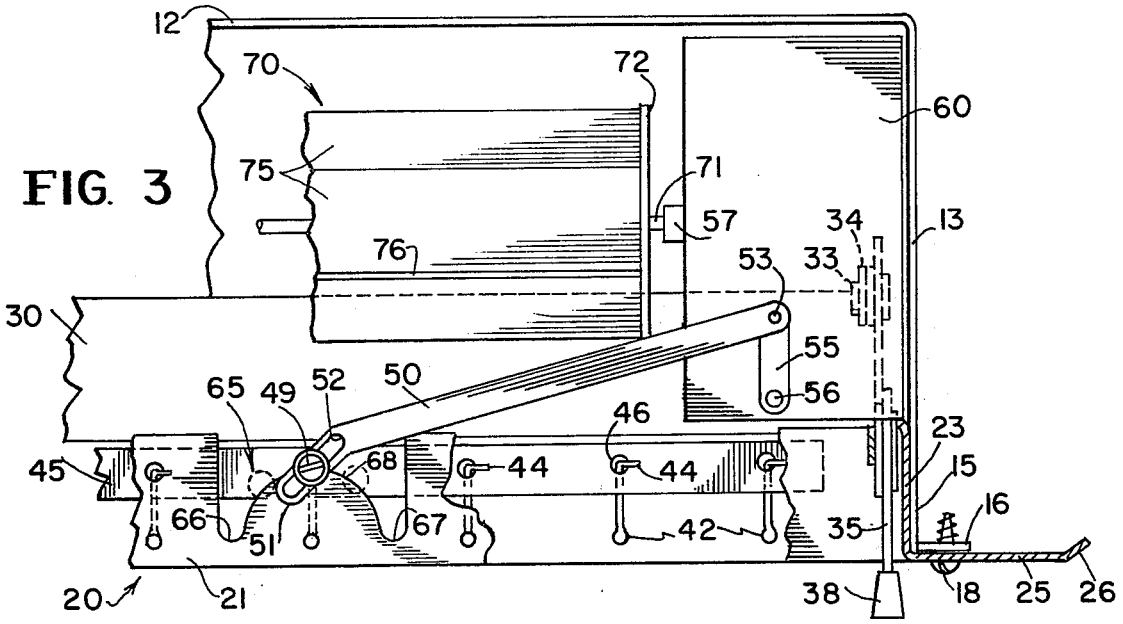
FIG. 3 is a fragmentary view in horizontal section taken along the line 3—3 in FIG. 2, with portions of the mechanism broken away more clearly to show the structure thereof.

In use, the adjustment lever 35 is manually operated to move the connecting rod 34 vertically and thereby pivot the horizontal louvers 30 in unison between a full open position, illustrated in FIGS. 3 and 4, wherein the louvers 30 are disposed substantially parallel to the top and bottom walls 21 and 22 of the register 20, and a full closed position (not shown) wherein the louvers 30 are disposed in substantially coplanar relationship parallel to the rear wall 12 of the duct 10, the louvers 30 being so dimensioned that when they are in the full closed position thereof they substantially close the outlet port defined by the register 20 and block the passage of air therethrough. It will be understood that the horizontal louvers 30 may also be moved to any intermediate position between the full open and full closed positions thereof to regulate the volume of air passing through the register 20.

The register 20 is also provided with a plurality of elongated and horizontally spaced-apart vertically extending louvers, each generally designated by the numeral 40, each of the louvers 40 being generally rectangular in shape and preferably formed of a sheet of metal folded in half lengthwise, with the longitudinal side edges seamed together by suitable means such as welding or the like, and with the fold forming a part-cylindrical portion 41 defining a tube-like aperture for receiving therein an elongated pivot rod 42. Each of the vertical louvers is provided with a pivot rod 42, the upper and lower ends of the pivot rod 42 being respectively received in suitable bearings carried by the top and bottom walls 21 and 22 of the register 20 to accommodate free rotational movement of the rods 42 about the longitudinal axes thereof. Preferably, each end of each of the pivot rods 42 is seated in a conical bearing cup (not shown) carried in the adjacent wall of the register 20.

Fixedly secured to the rear edge of each of the vertical louvers 40 at the upper end thereof is a generally L-shaped coupling pin 44, the coupling pins 44 being respectively received through complementary openings 46 in an elongated connecting rod 45 for pivotal movement with respect thereto. The center one of the vertical louvers 40 is provided with a connecting rod 47 in lieu of the coupling pin 44, the connecting rod 47 extending upwardly through a complementary opening in the connecting rod 45 and being secured at the upper end thereof to a bushing 48 which projects through an irregular recess of cutout in the inner edge of the top wall 21 of the register 20, the recess being generally designated by the numeral 65 (see FIG. 3).

Coupled to the bushing 48 is an elongated link arm 50 having an end portion 51 inclined with respect to the longitudinal axis of the link arm 50. The inclined end 51 is provided with an elongated oval slot 52 therein for receiving therethrough an attachment screw 49 which is threadedly engaged with the bushing 48. The opposite end of the link arm 50 is pivotally coupled by a pivot pin 53 to one end of a crank arm 55, the other end of which is fixedly secured to an output shaft 56 of a speed-reduction gear train assembly 60. Referring again to the recess 65 in the top wall 21 of the register 20, it is an irregular generally W-shaped recess including lobes 66 and 67 separated by a generally semicircular center hump 68 which defines a saddle-shaped portion of the recess 65.

A windmill 70 is disposed just beneath the top wall 21 of the register 20, the windmill 70 being a generally cylindrical elongated reel-type mechanism provided with an axial shaft 71 extending longitudinally thereof, the shaft 71 being supported at one end thereof in a suitable bearing (not shown) and being coaxially coupled at the other end thereof to an input shaft 57 of the gear train assembly 60 for rotation therewith. Respectively fixedly secured to the shaft 71 coaxially therewith adjacent to the opposite ends thereof are two circular end plates 72 and 73. Fixedly secured to the end plates 72 and 73 and extending longitudinally therebetween are a plurality of rectangular vanes 75. The vanes 75 are arranged tangent to an imaginary cylinder (indicated by broken line at 74 in FIG. 5) coaxial with the shaft 71 at equiangularly spaced-apart lines along said cylinder. The imaginary cylinder 74 has a diameter substantially less than the diameter of the end plates 72 and 73, and the vanes 75 all extend outwardly from the imaginary cylinder 74 in the same angular direction. The vanes 75 are all substantially identically constructed, the outer longitudinal edges 76 of the vanes 75 defining in use elements of an imaginary right circular cylinder having a diameter approximately equal to the diameter of the circular end plates 72 and 73, and indicated by broken line at 77 in FIG. 5.

Preferably, the windmill 70 has a maximum outer diameter no greater than approximately 1½ inches with a length of approximately 10 inches so that the windmill 70 can be easily accommodated within the register 20. More particularly, in use the windmill 70 is disposed horizontally adjacent to the end wall 17 of the duct 10 behind the vertical louvers 40 and above the horizontal louvers 30 in slightly overlapping relationship therewith when the louvers 30 are disposed in the full open position thereof. The gear train assembly 60 is disposed at one side of the register 20 at the top thereof, and is constructed and arranged so that the output shaft 56 rotates in response to rotation of the input shaft 57, but at a speed of rotation only a predetermined fraction of the speed of rotation of the input shaft 57. Any standard gear reduction assembly may be used, and it will also be understood that other speed-reduction devices may be used in place of the gear train assembly 60 if desired.

Figure 2:
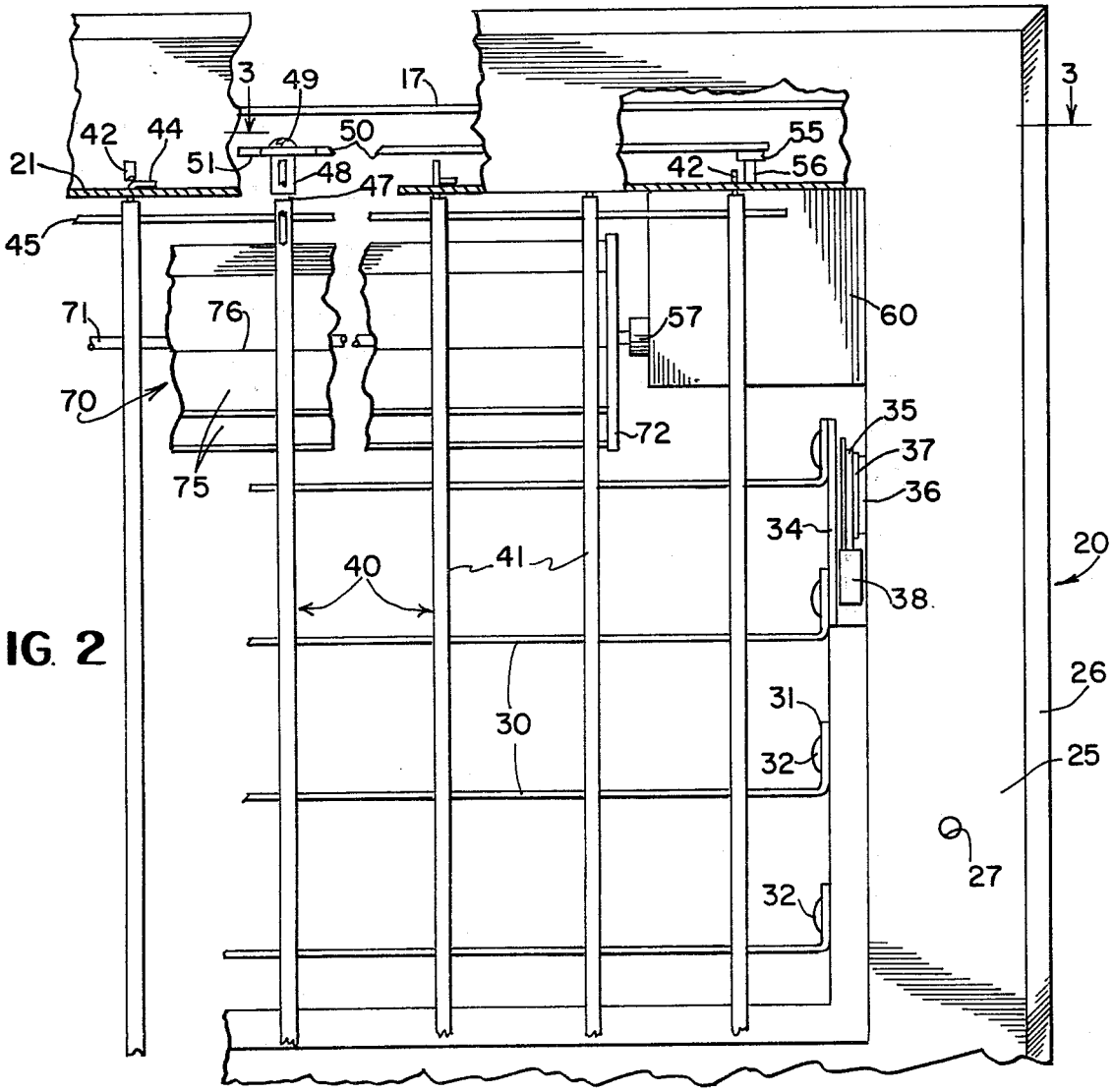
FIG. 2 is a fragmentary front elevational view of the air register of FIG. 1, with portions thereof broken away more clearly to show the underlying structure.

In operation, the adjustment lever 35 is first operated to move the horizontal louvers 30 to the full open positions thereof illustrated in FIG. 2, or to any intermediate position to achieve the desired volume of airflow through the register 20. When the air flows through the duct 10 from the blower of the heating or ventilation system, it tends to travel directly to the end wall 17 of the duct 10 and is then deflected out through the register 20. A portion of the airstream will be deflected out through the register 20 by the horizontal louvers 30 before reaching the top of the register 20, but at least a significant portion of the airstream will impinge upon the vane 75 of the windmill 70 effecting rotational movement thereof about the axis of the shaft 71. This rotation of the windmill 70 causes a corresponding slower rotation of the output shaft 56 of the gear train assembly 60, which in turn rotates the crank arm 55. As the crank arm 55 rotates, it operates the link arm 50 to effect an oscillatory back and forth movement of the center louver rod 47. The slot 52 in the link arm 50 causes a certain amount of lost motion, whereby the bushing 48 and center louver rod 47 move back and forth substantially between the positions illustrated in broken line in FIG. 3, thereby effecting a reciprocating and slightly arcuate movement of the connecting rod 45 to pivot the vertical louvers 40 back and forth. This oscillatory movement of the vertical louvers 40 causes the airstream emanating from the register 20 to sweep back and forth as it is deflected by the vertical louvers 40. This oscillatory movement will be continuous as long as the airstream through the ducts 10 continues.

If desired, an adjustment deflecting plate (not shown) could be mounted beneath the windmill 70 for movement to vary the volume of air which reaches and impinges upon the windmill 70, thereby to vary the speed of rotation thereof and, thus, the speed of oscillation of the vertical louvers 40. Also, such a movable deflecting plate could be adapted for engagement with the windmill 70, or other stop means engageable with the windmill 70 could be used, to prevent rotation thereof in order to lock the vertical louvers 40 in any predetermined position.

In a constructional model of the register 20, the walls 21 through 24, the louvers 30 and 40 and the pivot pins 42 and connecting rod 45 are preferably formed of metal. However, it will be appreciated that these parts, as well as the link arm 50 and crank arm 55 and the windmill 70 may be constructed of either metal or any other suitable material such as plastic, wood or the like. Preferably, however, the windmill 70 is constructed of lightweight material so as to reduce the drag thereof and increase the efficiency of operation of the mechanism.

While the windmill 70 has been illustrated with six vanes 75, it will be understood that any desired number of vanes 75 may be utilized, depending upon the volume of air driven through the ducts 10 by the main blower of the heating or ventilation system. The preferred embodiment illustrated in the drawings has been found suitable for operation with a standard home heating system producing a normal airflow of approximately 100 cubic feet per minute through the ducts 10, and will be suitable for operation with airflows as low as 75 cubic feet per minute. If desired, bracing discs (not shown), appropriately slotted to accommodate the vanes 75, could be mounted intermediate the end plates 72 and 73 to provide added rigidity to the windmill 70.

While a register 20 having both vertical and horizontal louvers 30 and 40 has been disclosed, it will be understood that the manually movable louvers may be dispensed with. Similarly, it will be understood that the system could be arranged to effect automatic oscillation of the horizontally disposed louvers rather than the vertically disposed louvers, by appropriate modification of the position and construction of the gear train assembly 60 and connecting linkage to the windmill 70.

From the foregoing, it can be seen that there has been provided a novel and improved air register for providing air-driven continuous oscillation of the register louvers for varying the direction of the airflow from the register. More particularly, there has been provided an air register of the character described having a novel windmill which is adapted for accommodation in a standard home wall duct having a maximum depth at the outlet of 2¾ inches, while at the same time generating sufficient power to drive a plurality of ganged louvers through a speed-reduction mechanism.

More particularly there has also been provided an elongated generally cylindrical reel-type windmill having a maximum outer diameter of no greater than about 1½ inches and disposable in the register for rotation about an axis disposed substantially perpendicular to the direction of the airstream through the duct.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An air register for directing a stream of air from a wall duct of a forced air heating or ventilation system, said register comprising a frame defining an air outlet port through which the associated stream of air may flow, air deflecting means carried by said frame in said outlet port for movement in the associated stream of air, air-driven rotary windmill means mounted on said frame for rotation by the associated stream of air about an axis disposed substantially perpendicular to the direction of the stream of air, said windmill means comprises an elongated generally cylindrical reel-type turbine coaxial with said axis, said windmill means having a maximum outer diameter of rotation no greater than about one and one-half inches and being disposed behind said air deflecting means and substantially in registry therewith so that all of the air which passes over said windmill means also passes through said air deflecting means, and linkage means operably coupling said windmill means and said air deflecting means to effect movement of said air deflecting means upon rotation of said windmill means by the associated stream of air thereby to vary the direction of the stream of air as it passes through said outlet port.

2. The air register set forth in claim 1, wherein said air deflecting means includes a plurality of louvers interconnected for movement in unison by said windmill means.

3. The air register set forth in claim 1, wherein said air deflecting means adapted for continuous oscillatory movement in response to rotation of said windmill means.

4. The air register set forth in claim 1, wherein said air deflecting means comprising a plurality of elongated louvers extending in a direction substantially perpendicular to said axis.

5. The air register set forth in claim 1, and further including second air deflecting means carried by said frame in said outlet port for movement in the associated stream of air, and means for manually moving said second air deflecting means between a full open condition permitting free passage of air through said outlet port and a full closed position substantially preventing passage of air through said outlet port.

6. An air register for directing a stream of air from a wall duct of a forced air heating or ventilation system, said register comprising a frame defining an air outlet port through which the associated stream of air may flow, air deflecting means carried by said frame in said outlet port for movement in the associated stream of air, air-driven rotary windmill means mounted on said frame for rotation by the associated stream of air about an axis disposed substantially perpendicular to the direction of the stream of air, said windmill means comprises an elongated generally cylindrical reel-type turbine coaxial with said axis, said windmill means having a maximum outer diameter of rotation no greater than about one and one-half inches and being disposed behind said air deflecting means and substantially in registry therewith so that all of the air which passes over said windmill means also passes through said air deflecting means, said windmill means including a pair of spaced-apart circular end members rotatably carried by said frame coaxial with said axis and a plurality of elongated vanes extending between said end members and supported thereby substantially parallel to said axis and equiangularly spaced therearound, and linkage means operably coupling said windmill means and said air deflecting means to effect movement of said air deflecting means upon rotation of said windmill means by the associated stream of air thereby to vary the direction of the stream of air as it passes through said outlet port.

7. The air register set forth in claim 6, wherein said axis extends substantially horizontally in use, said air deflecting means including a plurality of elongated vertically extending louvers interconnected for movement in unison in response to rotation of said windmill means.

8. The air register set forth in claim 6, wherein said axis extends substantially horizontally, said windmill means being disposed adjacent to the top of said outlet port.

9. An air register for directing a stream of air from a wall duct of a forced air heating or ventilation system, said register comprising a frame defining an air outlet port through which the associated stream of air may flow, air deflecting means carried by said frame in said outlet port for oscillatory movement in the associated stream of air, air-driven rotary windmill means mounted on said frame for rotation by the associated stream of air about an axis disposed substantially perpendicular to the direction of the stream of air, said windmill means comprises an elongated generally cylinderical reel-type turbine coaxial with said axis, said windmill means having a maximum outer diameter of rotation no greater than about one and one-half inches and being disposed behind said air deflecting means and substantially in registry therewith so that all of the air which passes over said windmill means also passes through said air deflecting means, said windmill means including a pair of spaced-apart circular end members rotatably carried by said frame coaxial with said axis and a plurality of elongated vanes extending between said end members and supported thereby substantially parallel to said axis and equiangularly spaced therearound, speed-reduction means having an input shaft coupled to said windmill means and rotatable therewith and an output shaft rotatable in response to the rotation of said input shaft at a predetermined fraction of the speed of rotation thereof, and crank mechanism coupled to said output shaft and to said air deflecting means and operable in response to rotation of said output shaft for effecting continuous oscillatory movement of said air deflecting means thereby to vary the direction of the stream of air as it passes through said outlet port.

10. The air register set forth in claim 9, wherein said axis extends substantially horizontally, said air deflecting means and said windmill means and said speed-reduction means and said crank mechanism all being dimensioned and arranged for accommodation in a space approximately two and three-fourths inches deep by 12 inches wide.

* * * * *